US007651355B2

(12) United States Patent
Feldman

(10) Patent No.: US 7,651,355 B2
(45) Date of Patent: Jan. 26, 2010

(54) FLOATING PANEL MOUNT CONNECTION SYSTEM

(75) Inventor: Steven Feldman, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/736,988

(22) Filed: Apr. 18, 2007

(65) Prior Publication Data

US 2008/0020618 A1 Jan. 24, 2008

Related U.S. Application Data

(60) Provisional application No. 60/806,405, filed on Jun. 30, 2006.

(51) Int. Cl.
*H01R 13/64* (2006.01)

(52) U.S. Cl. ..... 439/247

(58) Field of Classification Search ..... 439/247–278, 439/74

See application file for complete search history.

(56) References Cited

U.S. PATENT DOCUMENTS 5,002,497 A 3/1991 Plocek et al.
5,407,363 A 4/1995 Polgar et al.
5,888,093 A 3/1999 Polgar et al.
6,139,346 A 10/2000 Cecil, Jr. et al.
6,358,075 B1 * 3/2002 Tischner ..... 439/248
6,368,120 B1 4/2002 Scherer et al.
6,551,126 B1 4/2003 Feldman
6,767,244 B2 7/2004 Saito
6,780,069 B2 8/2004 Scherer et al.
6,824,427 B1 11/2004 Feldman et al.
6,902,416 B2 6/2005 Feldman
2003/0171029 A1 9/2003 Yamada et al.
2005/0239310 A1 10/2005 Baker

FOREIGN PATENT DOCUMENTS

JP 2001244029 A 9/2001

* cited by examiner

*Primary Examiner*—Renee Luebke
*Assistant Examiner*—Larisa Tsukerman
(74) *Attorney, Agent, or Firm*—Johannes P. M. Kusters

(57) ABSTRACT

A connection system for use with a panel having an aperture includes a connection device having a front portion and a back portion. The front portion is insertable in an axial direction into the aperture, and the back portion is configured to prevent passage through the aperture. A retainer releasably secured to the panel is positioned adjacent the back portion of the connection device and configured to provide predetermined limited floating movement of the connection device in at least the axial direction.

24 Claims, 7 Drawing Sheets

FLOATING PANEL MOUNT CONNECTION SYSTEM

CROSS REFERENCE TO RELATED APPLICATIONS

The present application claims priority to provisional U.S. Patent Application No. 60/806,405, filed Jun. 30, 2006.

BACKGROUND

The present disclosure relates generally to electrical connectors and, particularly, to an apparatus and system for mounting a connection device through an aperture in a panel and providing floating movement between the connection device and the panel.

Connectors designed for mounting through an aperture in a panel are known. For instance, a connector housing may be disposed at a first side of the panel, with a mating portion of the connector projecting through the aperture to a position projecting from a second side of the panel. Often, it is desirable that the connector "float" relative to the panel. That is, the connector can move within the aperture relative to the panel.

Panel mounted connectors, particularly when provided with floating movement, typically are complicated to manufacture and/or use. Complicated or intricate components used to provide floating movement lead to higher manufacturing costs. Often, such connectors take up large areas on the panel. For example, many panel mounted connectors have flanges which are necessarily long to envelope mounting screw holes and longer still to include larger diameter holes around the screws to provide X and Y axis float. The long flanges increase the overall area of the panel covered by a connector, and reduce the density of connector placement when end-to-end mounting is desired. The present invention provides a simple apparatus for supporting a variety of connection devices in an aperture in a panel, with floating movement between the connection device and the panel, while providing improved end-to-end connector/carrier/contactor mounting density.

SUMMARY

In one aspect, the invention described herein provides a connection system. In one embodiment, the connection system comprises: a panel having an aperture extending therethrough, the aperture defining an axial direction; a connection device having a front portion and a back portion, wherein the front portion is insertable in the axial direction into the aperture and configured to provide predetermined limited floating movement of the connection device in a plane of the panel, and wherein the back portion is configured to prevent passage of the connection device through the aperture; and a support block releasably secured to the panel in fixed relationship thereto, the support block positioned adjacent the back portion of the connection device and configured to provide predetermined limited axial floating movement of the connection device.

In another aspect, the invention described herein provides a connection system for use with a panel having an aperture extending therethrough, the aperture defining an axial direction. In one embodiment, the system comprises: a connection device having a front portion and a back portion, wherein the front portion is insertable in the axial direction into the aperture, and wherein the back portion is configured to prevent passage of the connection device through the aperture; and a retainer releasably secured to the panel in fixed relationship thereto, the retainer positioned adjacent the back portion of the connection device and configured to provide predetermined limited floating movement of the connection device in at least the axial direction.

In another aspect, the invention described herein provides an apparatus for supporting connection devices in adjacent apertures in a panel. In one embodiment, the apparatus comprises: a body defining a panel engagement surface and a plurality of connection device engagement surfaces, wherein the panel engagement surface is configured to engage a back side of the panel between the adjacent apertures and in fixed positional relationship with the panel, and wherein the connection device engagement surfaces are configured to engage back portions of the connection devices adjacent the back side of the panel, at least a portion of the connection device engagement surfaces axially spaced from the panel engagement surface by a distance sufficient to provide predetermined limited floating movement of the connection devices in an axial direction.

BRIEF DESCRIPTION OF THE DRAWINGS

Embodiments of the invention are better understood with reference to the following drawings. The elements of the drawings are not necessarily to scale relative to each other. Like reference numerals designate corresponding similar parts.

DETAILED DESCRIPTION

In the following detailed description, reference is made to the accompanying drawings, which form a part hereof, and in which is shown by way of illustration specific embodiments in which the invention may be practiced. The illustrated embodiments are not intended to be exhaustive of all embodiments according to the invention. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
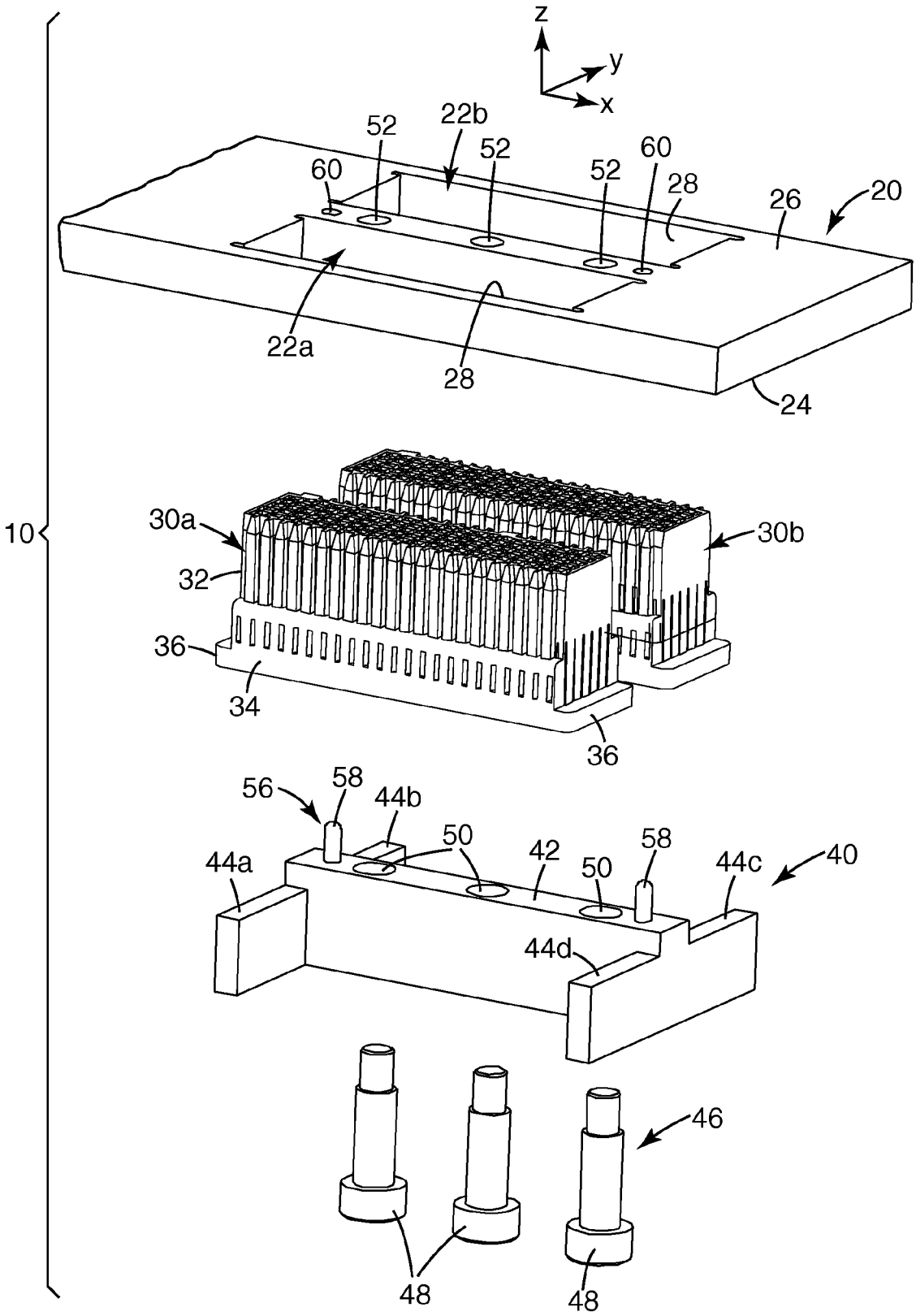
FIG. 1 is an exploded perspective illustration of one embodiment of a connection system according to the invention.
Figure 2:
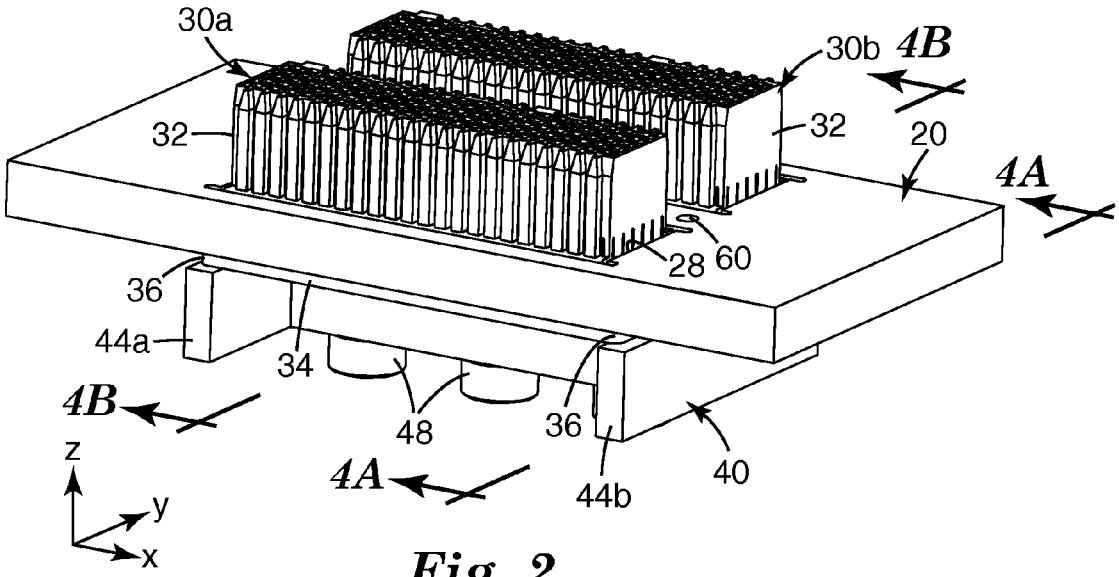
FIG. 2 is a perspective illustration of the connection system of FIG. 1 in an assembled condition.

With reference now to FIGS. 1 and 2 of the drawings, one embodiment of a connection system according to the invention is illustrated in an exploded and assembled condition, respectively. Referring to FIG. 1 in greater detail, a connection system generally indicated at 10 includes a panel 20 having apertures 22 extending therethrough, connection devices 30 configured for insertion into apertures 22, and a retainer or support block 40 configured to be releasably secured to panel 20 and provide limited floating movement of connection devices 30 within apertures 22.

It should be understood that for ease of description the connection system 10 is described herein with respect to a panel 20 having two apertures 22 (e.g., apertures 22*a* and 22*b*), a corresponding number of connection devices 30 (e.g., connection devices 30*a* and 30*b*), and a support block 40 configured for use with two apertures 22 and connection devices 30. However, the invention is not so limited. It practice, the panel 20 may have any number of apertures 22 and corresponding connection devices 30, and the support block 40 may be adapted for use with more or less than two apertures 22 and connection devices 30.

Panel 20 includes a back side 24 and a front side 26. Apertures 22 extend through panel 20 from back side 24 to front side 26 and define an axial direction (shown as the Z-axis in FIGS. 1 and 2). Apertures 22 further define an outer periphery 28. Outer periphery 28 is illustrated as substantially rectangular in shape, but may have any shape as necessary or desired for a particular application.

In the illustrations, connection devices 30 are identically formed. Accordingly, only one of connection devices 30 is described herein, with the description being applicable for each of connection devices 30. Each connection device 30 includes a front portion 32 and a back portion 34. Front portion 32 is configured to be inserted in the axial direction into a corresponding one of the apertures 22. In one embodiment, the size and shape of aperture 22 (as defined by outer periphery 28) and the size and shape of front portion 32 are selected to allow a predetermined and limited floating movement of connection device 30 in a plane of the panel (i.e., the X-Y plane of FIGS. 1 and 2). Back portion 34 is configured to prevent passage of the connection device 30 through aperture 22 after front portion 32 is inserted into aperture 22. In one embodiment, back portion 34 includes flanges 36 on opposed sides of connection device 30. In the illustrated embodiment, flanges 36 are shown on only two opposed sides of back portion 34. However, flanges 36 may be on each side of back portion 34. Flanges 36 may extend across the entire length of the opposed sides, or may extend only partially across the length of the exposed sides.

Figure 3:
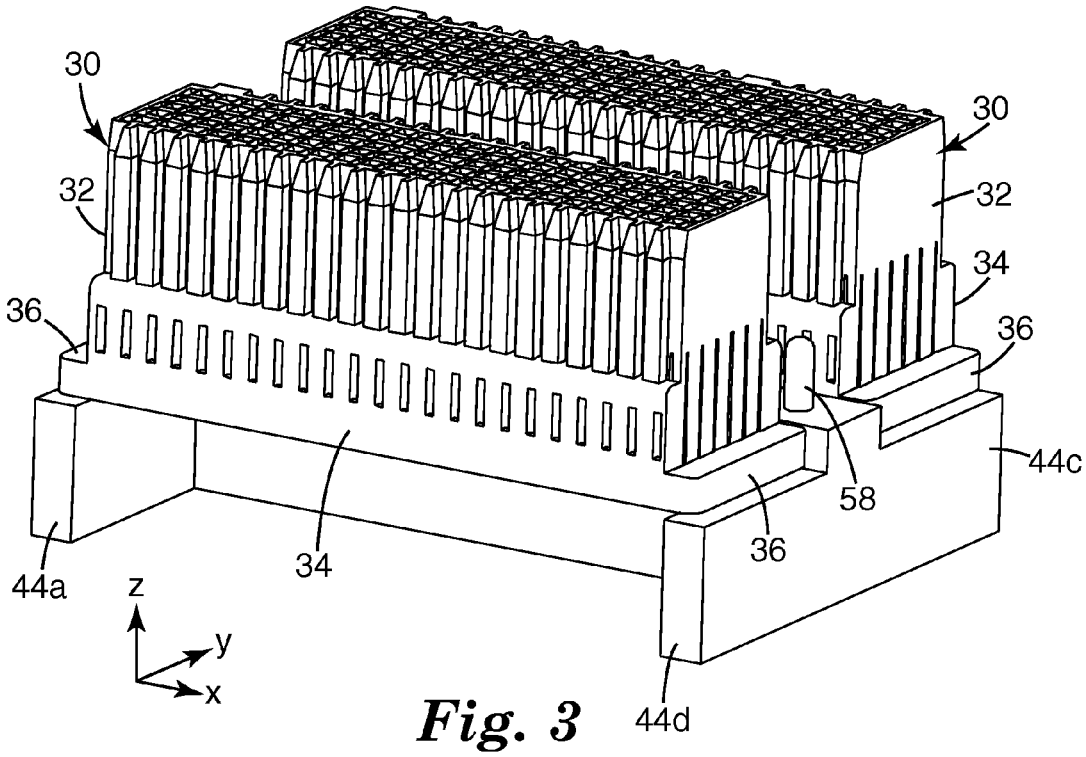
FIG. 3 is perspective illustration of the support block and connection device of FIG. 1, illustrating the connection device supported on the support block.

In one implementation, connection device 30 is a carrier configured to hold a plurality of connectors. For example, connection device 30 may be a carrier as described in U.S. Pat. No. 6,780,069, commonly assigned herewith and incorporated herein by reference. In another implementation, connection device 30 is itself a connector. For example, connection device 30 may be a connector as described in U.S. Pat. No. 6,368,120, commonly assigned herewith and incorporated herein by reference. In yet another implementation, connection device 30 is a probe block holding one or more probes. For example, connection device 30 may be a probe block as described in U.S. Pat. Nos. 6,551,126, 6,824,427 and 6,902,416, commonly assigned herewith and incorporated herein by reference Support block 40 is configured to be releasably secured to back side 24 of panel 20 in fixed relationship thereto, adjacent back portion 34 of at least one connection device 30. Support block 40 is further configured to provide predetermined limited axial (i.e., in the Z-direction) floating movement of the connection device 30 through its corresponding aperture 22. Accordingly, support block 40 defines a panel engagement surface 42 and a plurality of connection device engagement surfaces 44*a*, 44*b*, 44*c*, 44*d* (collectively referred to herein as "connection device engagement surfaces 44", or simply "engagement surfaces 44"). In one embodiment, as seen in FIG. 3, connection device engagement surfaces 44 are positioned to support flanges 36 of connection devices 30, in a manner further described below. Support block 40 is substantially inflexible, so as to closely control the movement of connection devices 30.

In the illustrated embodiment, support block 40 is formed as a unitary member and is generally H-shaped, such that panel engagement surface 42 of support block 40 engages back side 24 of panel 20 between two adjacent apertures 22 and supports a connection device 30 within each of the apertures 22. The illustrated support block 40 is configured to provide access to the back portion 34 of connection devices 30 when connection devices 30 are inserted into their respective aperture 22 and support block 40 is secured to panel 20. In this manner, cables, wires and the like may freely extend from connection devices 30 without interference and support block 40 may be easily positioned around connection devices 30 with attached cables or wires. In other embodiments, support block 40 may be configured to support more or less than two connection devices 30, may have a shape other than the illustrated H-shape, and/or may be formed from more than one piece.

Panel engagement surface 42 is held securely against panel 20 via fastening means 46. In the illustrated embodiment, fastening means 46 comprise one or more threaded fasteners 48 that pass through openings 50 in support block 40 and engage corresponding threaded openings 52 in panel 20, although any fastening device that permits disengagement of support block 40 from panel 20 may be used. It will readily be recognized that the numbers and positions of fasteners 48 may be altered from those shown. In addition, the fastening means 46 may optionally provide a keying function, such as by asymmetrically positioning fasteners 48.

In some implementations, means for aligning support block 40 on plate 20 may be necessary or desired. In the illustrated embodiment, support block 40 and panel 20 include optional alignment means 56 that are configured to accurately position and retain support block 40 with respect to apertures 22. In the illustrated embodiment, alignment means 56 comprise pins 58 extending from panel engagement surface 42, and corresponding holes 60 in panel 20 for receiving pins 58. It will readily be recognized that the numbers and positions of pins 58 and holes 60 may be altered from those shown, including placing pins 58 on panel 20 and forming holes 60 in support block 40. Alignment means 56 other than or in addition to pins 58 and holes 60 may be provided. For example, panel engagement surface 42 may be received in a mating slot (not shown) in panel 20. Alignment means 56 may optionally provide a keying function, such as by making the alignment means asymmetrical.

Figure 4A:
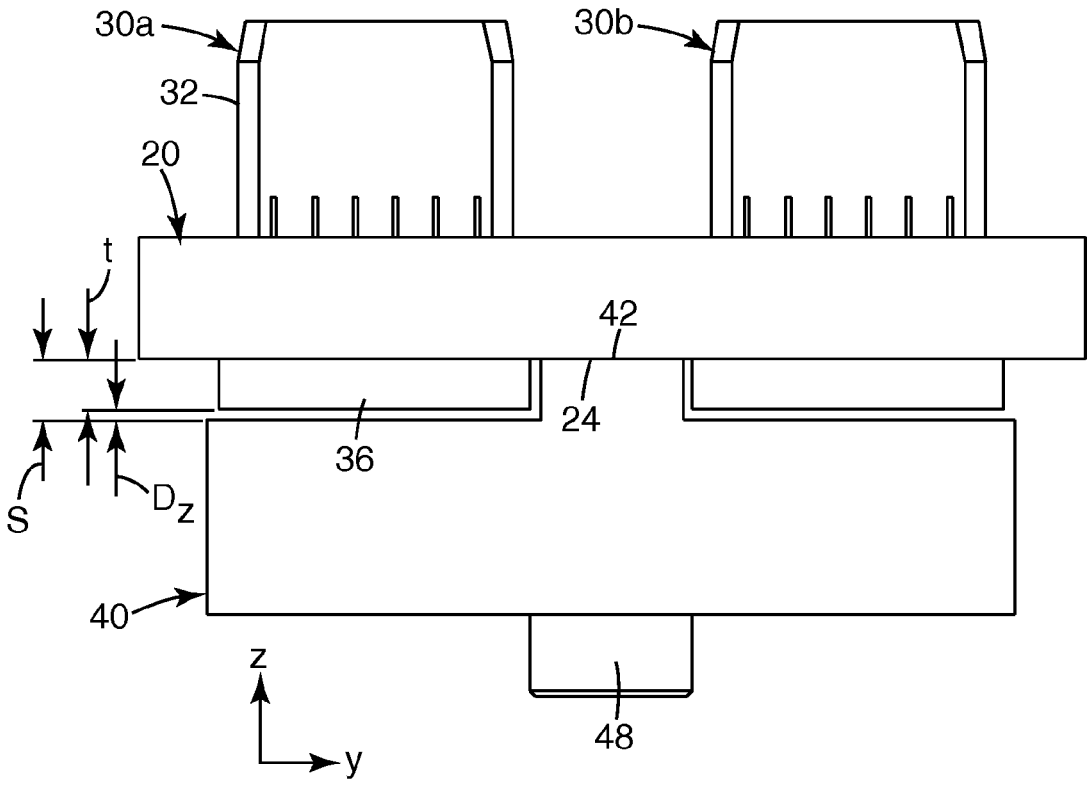
FIG. 4A is an end illustration of the connection system taken along line 4A-4A of FIG. 2.
Figure 4B:
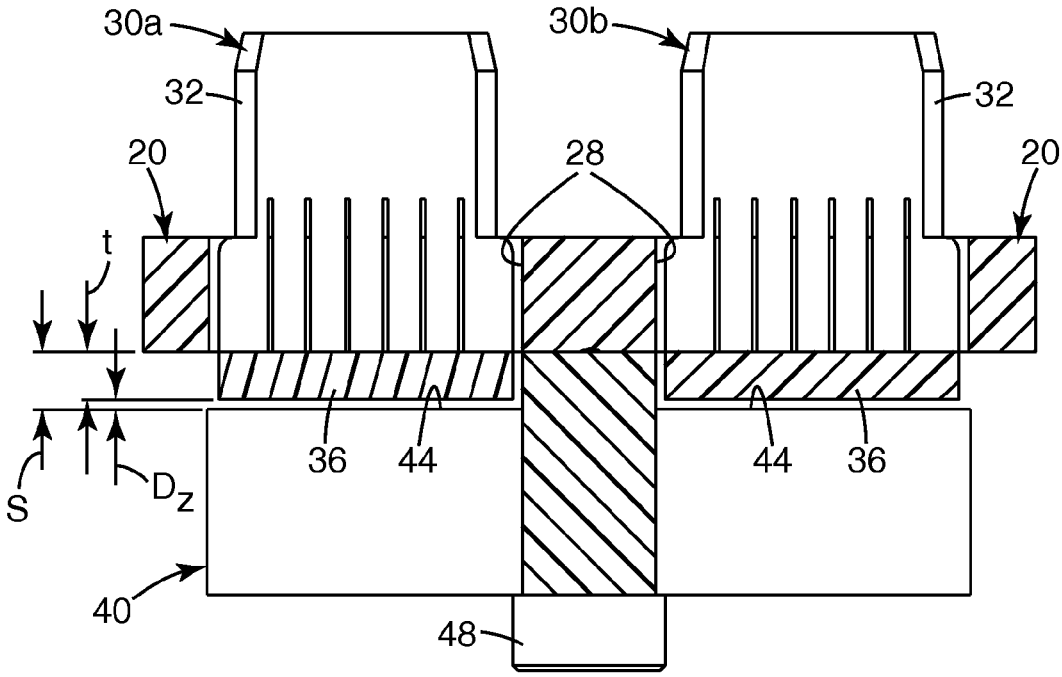
FIG. 4B is a cross-sectional illustration of the connection system taken along line 4B-4B of FIG. 2.

Connection device engagement surfaces 44 of support block 40 are axially spaced (i.e., along the Z-axis in FIGS. 1 and 2) from the panel engagement surface 42 by a distance sufficient to provide predetermined limited floating movement of connection devices 30 in an axial direction when support block 40 is secured to panel 20. The actual spacing between panel engagement surface 42 and connection device engagement surfaces 44 will depend on the thickness t of flanges 36 on connection devices 30, and the desired range of movement of connection devices 30 along the Z-axis. As best seen in FIG. 4, thickness t of flanges 36 is less than spacing s between connection device engagement surfaces 44 and back side 24 of panel 20, such that connection device 30 can move or "float" along the Z-axis. In one implementation, the Z-axis float distance DZ (i.e., the difference between spacing s and thickness t) is approximately 0.5 mm.

Figure 5:
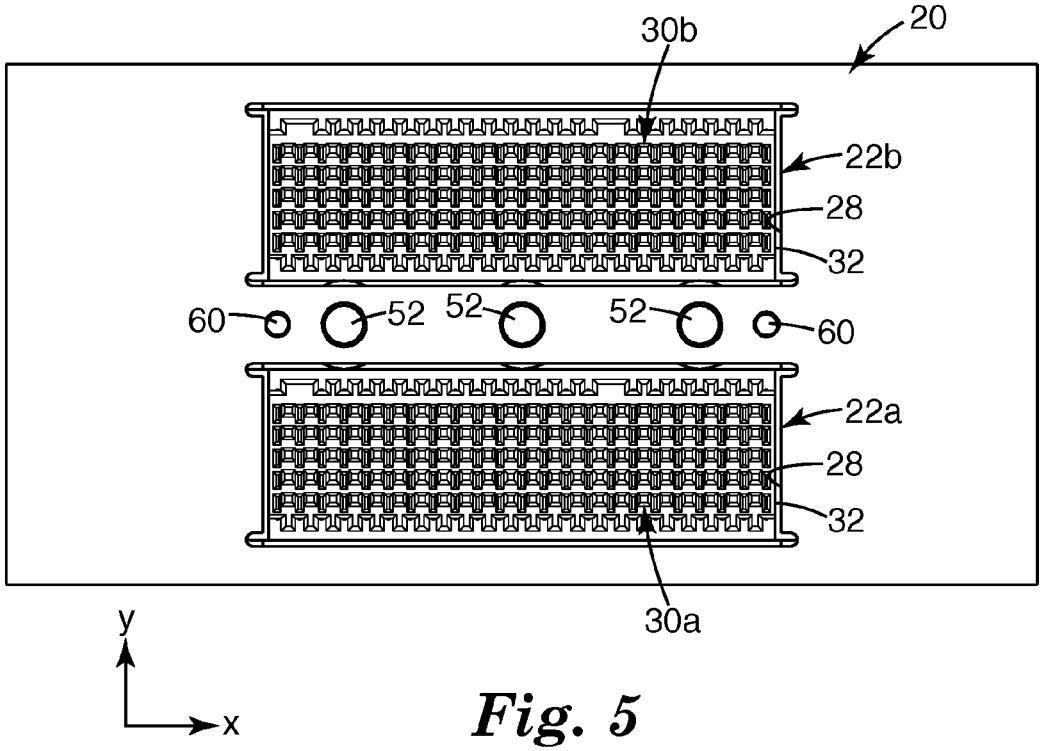
FIG. 5 is a top illustration of the assembled connection system of FIG. 2, illustrating spacing between the connection devices and the periphery of the panel apertures.

In one embodiment, movement or float of connection devices 30 in the X- and Y-axis directions is controlled by the size and shape of aperture 22 as it relates to the size and shape of front portion 32 of connection devices 30. As best seen in FIG. 5, in the X-Y plane, outer periphery 28 of aperture 22 defines a generally rectangular shape that is slightly larger than a similar shape defined by front portion 32 of connection device 30, such that a space is provided between outer periphery 28 and front portion 32. Accordingly, connection device 30 may move in the X and Y directions a predetermined and limited distance. When moving in the X and Y directions, flanges 36 are free to slide against back side 24 of panel 20 and connection device engagement surfaces 44. The size and/or shape of aperture 20 and front portion 32 of connection devices 30 are selected and controlled to provide the desired amount of float in the X and Y directions. The amount of float may be the same or different in the X and Y directions. In one implementation, the X-axis float DX is approximately 0.5 mm, and the Y-axis float DY is approximately 0.5 mm. In other embodiments, float provided in the X, Y and Z directions may be more or less than 0.5 mm.

Figure 6:
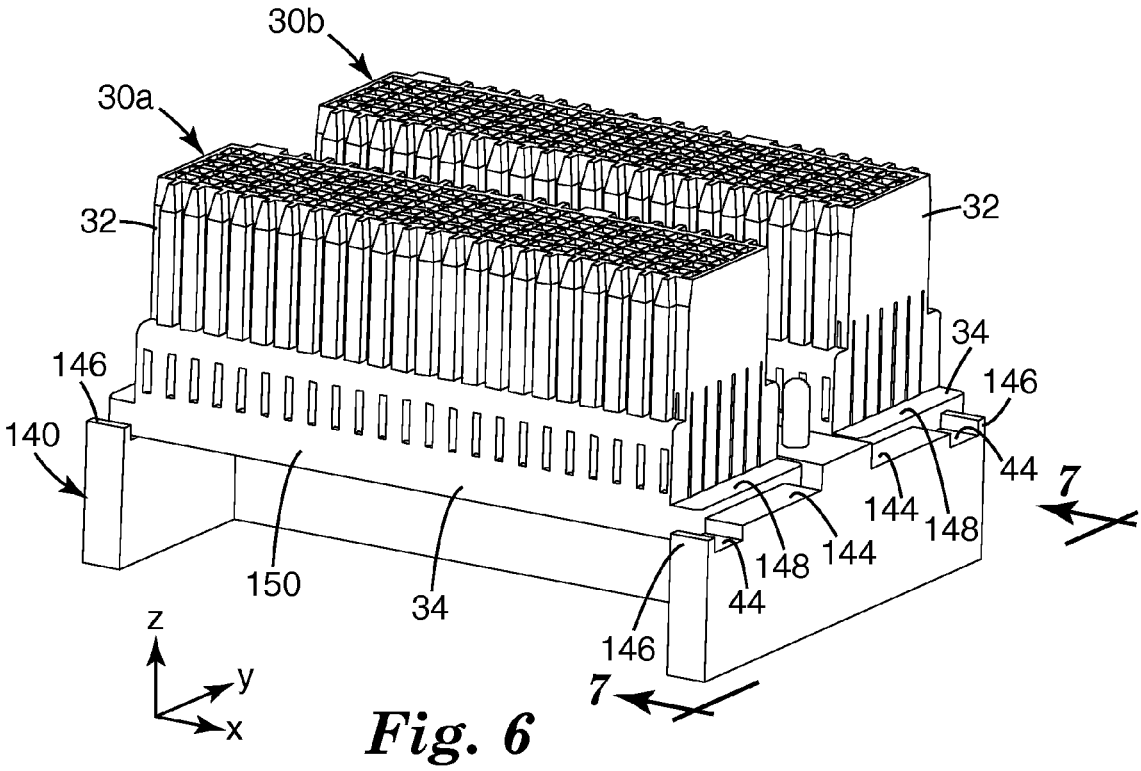
FIG. 6 is a perspective illustration of another embodiment of a support block and connection device according to the invention.
Figure 7:
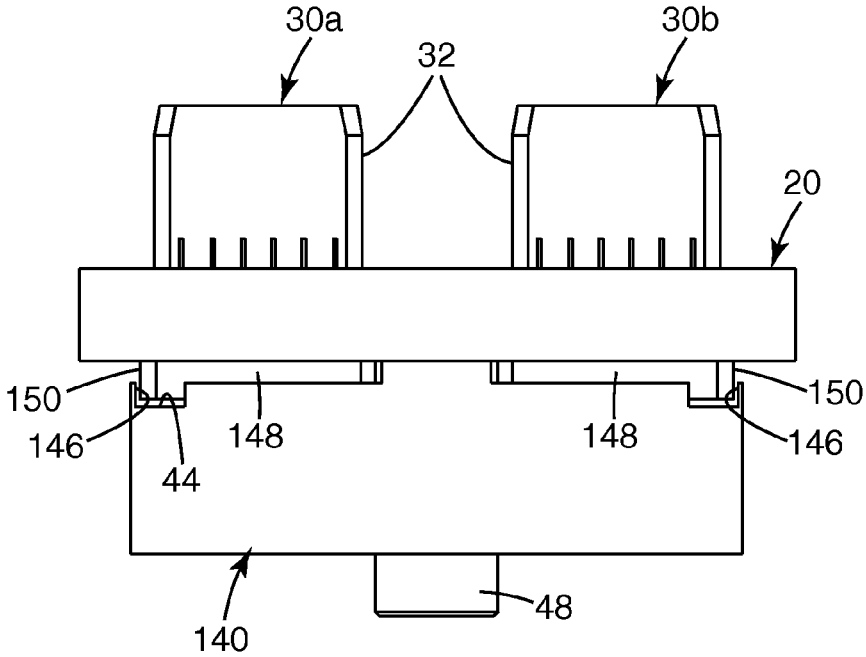
FIG. 7 is an end illustration of a connection system using the support block of FIG. 6, from the direction of line 7-7 in FIG. 6.
Figure 8:
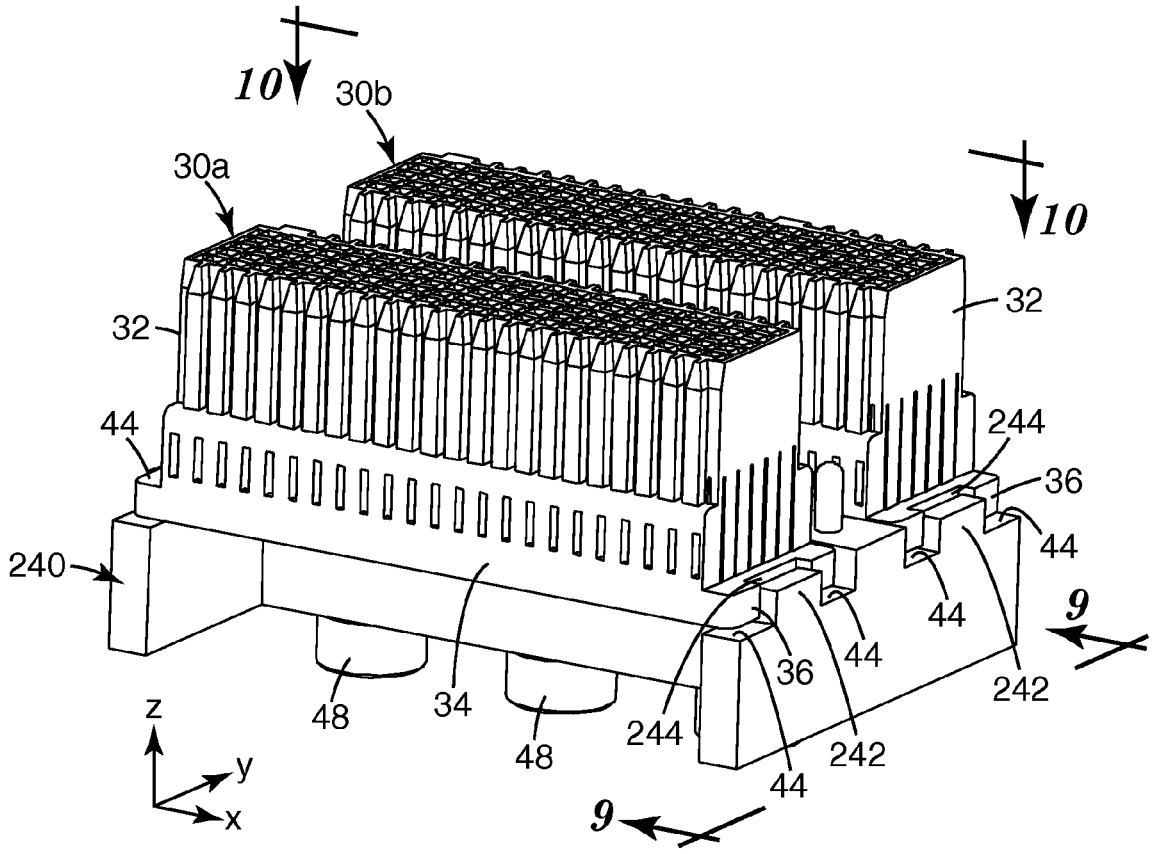
FIG. 8 is a perspective illustration of another embodiment of a support block and connection device according to the invention.

In another embodiment according to the invention, movement or float of connection devices 30 in the X- and Y-axis directions is controlled by the support block, rather than by outer periphery 28 of aperture 22. The size and/or shape of apertures 20 may thus be manufactured with increased tolerances. An exemplary implementation of a support block 140 that controls float of connectors 30 in the X, Y and Z directions is illustrated in FIGS. 6 and 7. Another exemplary implementation of a support block 240 that controls float of connectors 30 in the X, Y and Z directions is illustrated in FIGS. 8-11.

Referring now to FIGS. 6 and 7, support block 140 includes features identical or similar to those of support block 40, and such identical or similar features are identically numbered. Support block 140 includes connection device engagement surfaces 44 for controlling Z-axis float DZ in the manner described with respect to support block 40. Support block 140 further includes connection device engagement surfaces that are laterally spaced from back portion 34 of connection devices 30 to provide predetermined limited floating movement of the connection devices 30 in a direction transverse to the axial direction (i.e., transverse to the Z-axis). In particular, support block 140 includes connection device engagement surfaces 144 for controlling X-axis float DX, and connection device engagement surfaces 146 for controlling Y-axis float DY. Connection device engagement surfaces 144, 146 are positioned to engage side surfaces 148, 150, respectively, of back portion 34 of connection device 30, and thereby provide predetermined limited transverse (i.e., in the X and/or Y direction) floating movement of the connection device 30. When moving in the X and Y directions, flanges 36 are free to slide against back side 24 of panel 20 and connection device engagement surfaces 44. Similarly, when moving in the Z direction, side surfaces 148, 150 are free to slide against engagement surfaces 144, 146, respectively. The amount of float may be the same or different in the X and Y directions. In one implementation, the X-axis float DX is approximately 0.5 mm, and the Y-axis float DY is approximately 0.5 mm. In other embodiments, float provided in the X, Y and Z directions may be more or less than 0.5 mm.

Figure 9:
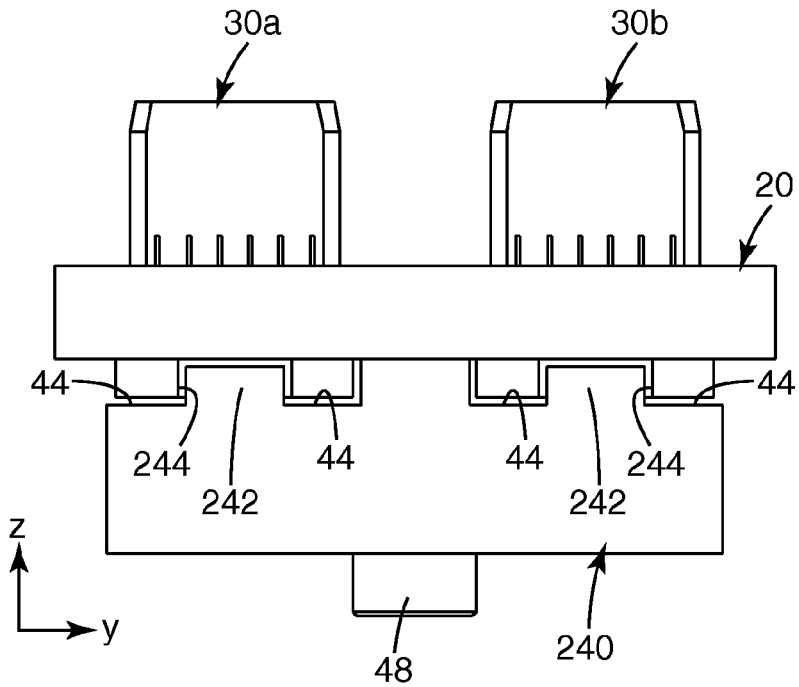
FIG. 9 is an end illustration of a connection system using the support block of FIG. 8. from the direction of line 9-9 in FIG. 8.
Figure 10:
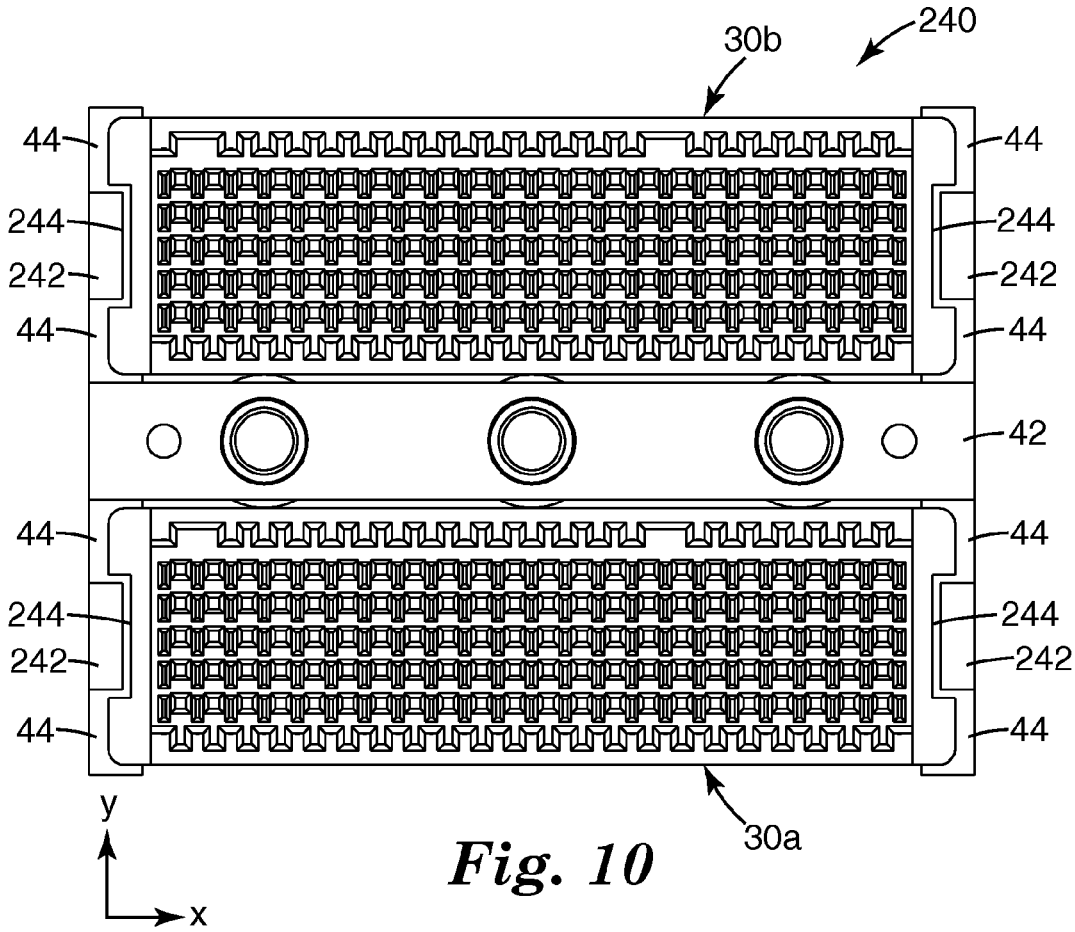
FIG. 10 is a top illustration of the support block and connection devices taken along line 10-10 in FIG. 8.
Figure 11:
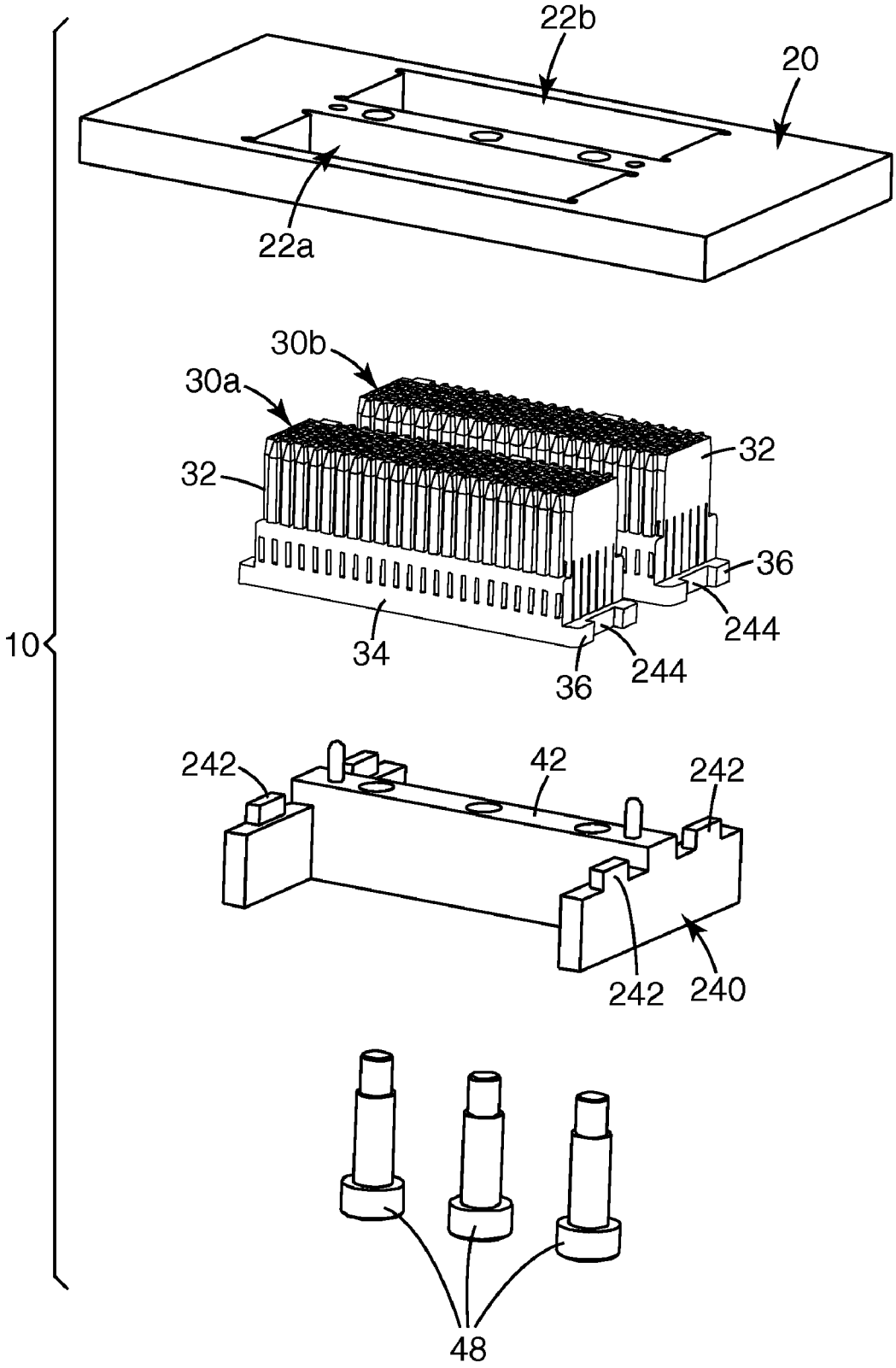
FIG. 11 is an exploded perspective illustration of a connection system according to the invention, using the support block of FIG. 8.

Referring now to FIGS. 8-11, support block 240 includes features identical or similar to those of support block 40, and such identical or similar features are identically numbered. Support block 240 includes connection device engagement surfaces 44 for controlling Z-axis float DZ in the manner described with respect to support block 40. Support block 240 further includes connection device engagement surfaces that are laterally spaced from back portion 34 of connection devices 30 to provide predetermined limited floating movement of the connection devices 30 in a direction transverse to the axial direction (i.e., transverse to the Z-axis). In particular, support block 240 includes tabs 242 that mate with slots 244 in flanges 36 of connection devices 30. As best seen in FIGS. 9 and 10, the relative dimensions of tabs 242 and slots 244 are selected to provide the desired range of movement or float of connection devices 30 in the X and Y directions. The amount of float may be the same or different in the X and Y directions. In one implementation, the X-axis float DX is approximately 0.5 mm, and the Y-axis float DY is approximately 0.5 mm. In other embodiments, float provided in the X, Y and Z directions may be more or less than 0.5 mm.

In each of the embodiments and implementations described herein, the various components of the connection system and elements thereof are formed of any suitable material. The materials are selected depending upon the intended application and may include both polymers and metals. In one embodiment, the panel 20, connection devices 30 and/or support blocks 40, 140, 240 are formed of polymeric materials by methods such as injection molding, extrusion, casting, machining, and the like. In another embodiment, the panel 20, connection devices 30 and/or support blocks 40, 140, 240 are formed of metal by methods such as molding, casting, stamping, machining the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate or equivalent implementations may be substituted for the specific embodiments shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A connection system comprising:

a panel having an aperture extending therethrough, the aperture defining an axial direction;

a connection device having a front portion and a back portion, wherein the front portion is insertable in the axial direction into the aperture, and wherein the back portion is configured to prevent passage of the connection device through the aperture; and a support block releasably secured to the panel in fixed relationship thereto, the support block positioned adjacent the back portion of the connection device and configured to allow insertion of the connection device in the support block in a direction lateral to the axial direction, wherein the aperture of the panel is configured to provide predetermined limited floating movement of the connection device in a plane of the panel, and wherein the support block and the panel are cooperatively configured to provide predetermined limited axial floating movement of the connection device when the connection device is in the aperture and the support block is secured to the panel.

2. The system of claim 1, wherein the connection device comprises a connector.

3. The system of claim 1, wherein the connection device comprises a carrier configured to hold a plurality of connectors.

4. The system of claim 1, wherein the support block is configured to provide access to the back portion of the connection device when connection device is in the aperture and the support block is secured to the panel.

5. The system of claim 1, wherein the aperture is a first aperture and the connection device is a first connection device, and further comprising:

a second aperture extending through the panel, the second aperture positioned adjacent the first aperture;

a second connection device having a front portion and a back portion, wherein the front portion is insertable in the axial direction into the second aperture, and wherein the back portion is configured to prevent passage of the second connection device through the second aperture;

wherein the support block is positioned between the back portions of the first and second connection devices and configured to allow insertion of the first and second connection devices in the support block in a direction lateral to the axial direction, wherein the first and second apertures of the panel are configured to provide predetermined limited floating movement of the first and second connection devices, respectively, in a plane of the panel, and wherein the support block and the panel are cooperatively configured to provide predetermined limited axial floating movement of the first and second connection devices when the first and second connection devices are in the first and second apertures, respectively, and the support block is secured to the panel.

6. The system of claim 5, wherein the first aperture and the second aperture are substantially identical, and wherein the first connection device and the second connection device are substantially identical.

7. The system of claim 5, wherein the support block is configured to provide access to the back portions of the first and second connection devices when first and second connection devices are in the first and second apertures, respectively, and the support block is secured to the panel.

8. A connection system for use with a panel having an aperture extending therethrough, the aperture defining an axial direction, the system comprising:

a connection device having a front portion and a back portion, wherein the front portion is msertable in the axial direction into the aperture, and wherein the back portion is configured to prevent passage of the connection device through the aperture; and a retainer releasably secured to the panel in fixed relationship thereto, the retainer positioned adjacent the back portion of the connection device and configured to allow insertion of the connection device in the retainer in a direction lateral to the axial direction, wherein the retainer is configured to cooperate with the panel to provide predetermined limited floating movement of the connection device in at least the axial direction when the connection device is in the aperture and the retainer is secured to the panel.

9. The system of claim 8, wherein the retainer is further configured to cooperate with the panel to provide predetermined limited floating movement of the connection device in a first direction transverse to the axial direction when the connection device is in the aperture and the retainer is secured to the panel.

10. The system of claim 9, wherein the retainer is further configured to cooperate with the panel to provide predetermined limited floating movement of the connection device in a second direction transverse to the axial direction when the connection device is in the aperture and the retainer is secured to the panel.

11. The system of claim 8, wherein the retainer is configured to provide access to the back portion of the connection device when connection device is in the aperture and the retainer is secured to the panel.

12. The system of claim 8, wherein the panel has a plurality of apertures extending therethrough, the connection device is a first connection device, the aperture is a first one of the plurality of apertures, and further comprising:

a second connection device having a front portion and a back portion, wherein the front portion is insertable in the axial direction into a second one of the plurality of apertures adjacent the first one of the plurality of apertures, and wherein the back portion of the second connection device is configured to prevent passage of the second connection device through the second one of the plurality of apertures;

wherein the retainer is positioned between the back portions of the first and second connection devices and configured to allow insertion of the first and second connection devices in the retainer in a direction lateral to the axial direction, the retainer configured to cooperate with the panel to provide predetermined limited floating movement of the first and second connection devices in at least the axial direction when the first and second connection devices are in the first and second one of the plurality of apertures, respectively, and the retainer is secured to the panel.

13. The system of claim 12, wherein the retainer is further configured to cooperate with the panel to provide predetermined limited floating movement of the first and second connection devices in a first direction transverse to the axial direction when the first and second connection devices are in the first and second one of the plurality of apertures, respectively, and the retainer is secured to the panel.

14. The system of claim 13, wherein the retainer is further configured to cooperate with the panel to provide predetermined limited floating movement of the first and second connection devices in a second direction transverse to the axial direction when the first and second connection devices are in the first and second one of the plurality of apertures, respectively, and the retainer is secured to the panel.

15. The system of claim 13, wherein the retainer is configured to provide access to the back portions of the first and second connection devices when the retainer is secured to the panel.

16. The system of claim 13, wherein the first and second ones of the plurality of apertures are substantially identical, and wherein the first and second connection devices are substantially identical.

17. The system of claim 8, wherein the connection device comprises a connector.

18. The system of claim 8, wherein the connection device comprises a carrier configured to hold a plurality of connectors.

19. The system of claim 8, wherein the connection device comprises a probe block configured to hold at least one electrical probe.

20. An apparatus for supporting connection devices in adjacent apertures in a panel, the apparatus comprising: a support block defining a panel engagement surface and a plurality of connection device engagement surfaces, wherein the panel engagement surface is configured to engage a back side of the panel between the adjacent apertures and in fixed positional relationship with the panel, and wherein the connection device engagement surfaces are configured to engage back portions of the connection devices adjacent the back side of the panel, at least a portion of the connection device engagement surfaces axially spaced from the panel engagement surface by a distance sufficient to provide predetermined limited floating movement of the connection devices in an axial direction.

21. The apparatus of claim 20, wherein another portion of the connection device engagement surfaces are laterally spaced from the back portion of the connection devices to provide predetermined limited floating movement of the connection devices in a direction transverse to the axial direction.

22. The apparatus of claim 20, wherein the support block defines a generally H-shape.

23. The apparatus of claim 20, wherein the support block is substantially inflexible.

24. The apparatus of claim 20, wherein the support block is a unitary member.

* * * * *

UNITED STATES PATENT AND TRADEMARK OFFICE

CERTIFICATE OF CORRECTION

PATENT NO. : 7,651,355 B2
APPLICATION NO. : 11/736988
DATED : January 6, 2010
INVENTOR(S) : Steven Feldman It is certified that error appears in the above-identified patent and that said Letters Patent is hereby corrected as shown below:

Title Page, Item [*] Notice:

The phrase "by 0 days" shall reflect as such appears on Letters Patent.

Column 7,
Line 61, Claim 8, delete "msertable" and insert --insertable-- therefor.

Signed and Sealed this

Second Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,651,355 B2
APPLICATION NO. : 11/736988
DATED : January 6, 2010
INVENTOR(S) : Steven Feldman It is certified that error appears in the above-identified patent and that said Letters Patent is hereby corrected as shown below:

Title Page, Item [*] Notice:

The phrase "by 492 days" shall reflect as such on Letters Patent.

Signed and Sealed this

Twenty-third Day of November, 2010

David J. Kappos

David J. Kappos
*Director of the United States Patent and Trademark Office*